US010132329B2

(12) United States Patent
Tsubokawa

(10) Patent No.: US 10,132,329 B2
(45) Date of Patent: Nov. 20, 2018

(54) VACUUM PUMP

(71) Applicant: SHIMADZU CORPORATION, Kyoto (JP)

(72) Inventor: Tetsuya Tsubokawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 906 days.

(21) Appl. No.: 14/559,413

(22) Filed: Dec. 3, 2014

(65) Prior Publication Data

US 2015/0176601 A1 Jun. 25, 2015

(30) Foreign Application Priority Data

Dec. 25, 2013 (JP) ..... 2013-267643

(51) Int. Cl.
*F04D 29/52* (2006.01)
*F04D 19/04* (2006.01)

(52) U.S. Cl.
CPC ..... *F04D 29/522* (2013.01); *F04D 19/042* (2013.01); *F04D 19/044* (2013.01)

(58) Field of Classification Search
CPC ..... F04D 19/04; F04D 19/042; F04D 19/044; F04D 19/046; F04D 19/048; F04D 29/522; F04D 29/541; F04D 29/545
USPC ..... 415/90; 417/423.4
See application file for complete search history.

(56) References Cited

U.S. PATENT DOCUMENTS 7,798,788 B2 * 9/2010 Varennes ..... F04D 19/042 285/368
2005/0244219 A1 11/2005 Mathes et al.
2007/0104598 A1 5/2007 Varennes et al.
2008/0260518 A1 10/2008 Blumenthal et al.
(Continued)

FOREIGN PATENT DOCUMENTS

JP 01-219393 A 9/1989
JP 2005-537418 12/2005
(Continued)

OTHER PUBLICATIONS

Office Action for corresponding Japanese Patent Application No. 2013-267643, dated Aug. 1, 2017 (English translation).
(Continued)

*Primary Examiner* — Kenneth Bomberg
*Assistant Examiner* — Julian Getachew
(74) *Attorney, Agent, or Firm* — Renner, Otto, Boisselle & Sklar, LLP

(57) ABSTRACT

A vacuum pump comprises a vacuum exhaust section, the vacuum exhaust section including a stator, and a rotor having a rotor cylindrical section, the rotor cylindrical section discharging gas in cooperation with the stator, a suction port; a base; an exhaust port disposed on the base, wherein at least a part of the exhaust port faces an outer peripheral surface of the stator, and gas sucked through the suction port by the vacuum exhaust section is discharged through the exhaust port; and a conductance increasing function section formed on at least one of the outer peripheral surface of the stator and an inner peripheral surface of the base, the outer peripheral surface and the inner peripheral surface facing an exhaust path for gas discharged by the rotor cylindrical section and the stator leading to the exhaust port.

7 Claims, 8 Drawing Sheets

(56) References Cited

U.S. PATENT DOCUMENTS

| | | | |
|---|---|---|---|
| 2012/0141254 | A1 | 6/2012 | Ohtachi et al. |
| 2016/0025096 | A1 | 1/2016 | Shi et al. |

FOREIGN PATENT DOCUMENTS

| | | |
|---|---|---|
| JP | 2007-132346 | 5/2007 |
| JP | 2008-531909 | 8/2008 |
| JP | 4594689 | 9/2010 |
| JP | 2011-7049 | 1/2011 |
| JP | 5420323 | 11/2013 |
| WO | WO 2011/024528 | 3/2011 |
| WO | 2014/119191 A1 | 8/2014 |

OTHER PUBLICATIONS

English translation of Chinese Office Action for corresponding Chinese Application No. 201410787749.5 dated Aug. 30, 2016.

* cited by examiner

A
B
C
R1
R2
T1
ST
s1
s2
s3
sa
sb
11
11a
11b
11c
11d
11e
50b
56
56a
56b
100

VACUUM PUMP

BACKGROUND OF THE INVENTION

1. Field of the Invention

The present invention relates to a vacuum pump.

2. Description of the Related Art

A vacuum pump typified by a turbo-molecular pump is attached to a vacuum chamber of a dry etching apparatus or a CVD apparatus. A turbo-molecular pump is provided with a rotor which includes rotor blades and a rotor cylindrical section, stator blades which are arranged to face the rotor blades, and a screw stator which is arranged to face the rotor cylindrical section in the radial direction. The rotor rotates at high speed, specifically, at several tens of thousands revolutions per minute. The rotation of the rotor causes the rotor blades and the stator blades to cooperate with each other and causes the rotary cylindrical section and the screw stator to cooperate with each other. As a result, gas inside the vacuum chamber is discharged, which generates a high vacuum state inside the vacuum chamber.

In the above dry etching apparatus or CVD apparatus, there have been increasing cases in which a large amount of process gas is used to perform various kinds of processing. Even when a large amount of process gas is used, it is necessary to maintain a high vacuum state. Thus, a vacuum pump having a higher exhaust performance is desired. As a result, the number of stages in a vacuum pump tends to increase.

On the other hand, the height of the above dry etching apparatus or CVD apparatus is designed to allow an operator to easily perform an operation using the apparatus. A vacuum pump is typically attached to the bottom of the apparatus, and the height of the vacuum pump is thus restricted by the distance between the lower surface of the apparatus and a placement surface.

In order to design a vacuum pump to meet the above demands, an exhaust port may be arranged at a position facing a screw stator as described in Patent Literature 1 (Japanese Patent No. 4594689).

In such a case, an exhaust path for gas discharged by cooperation between a rotor cylindrical section and a screw stator leading to an exhaust port is narrowed, and the conductance of the exhaust path is thereby deteriorated. As a result, the exhaust performance of the vacuum pump is deteriorated.

SUMMARY OF THE INVENTION

A vacuum pump comprises a vacuum exhaust section, the vacuum exhaust section including a stator, and a rotor having a rotor cylindrical section, the rotor cylindrical section discharging gas in cooperation with the stator, a suction port; a base; an exhaust port disposed on the base wherein at least a part of the exhaust port faces an outer peripheral surface of the stator, and gas sucked through the suction port by the vacuum exhaust section is discharged through the exhaust port; and a conductance increasing function section formed on at least one of the outer peripheral surface of the stator and an inner peripheral surface of the base, the outer peripheral surface and the inner peripheral surface facing an exhaust path for gas discharged by the rotor cylindrical section and the stator leading to the exhaust port.

The conductance increasing function section is formed on the outer peripheral surface of the stator, a shape of the outer peripheral surface of the stator allows a distance between the outer peripheral surface of the stator in a region facing the exhaust port and the inner peripheral surface of the base to be larger than a distance between the outer peripheral surface of the stator in a region locating on the suction port side and not facing the exhaust port and the inner peripheral surface of the base.

The stator includes a tapered structure formed on the whole circumference of a part of the outer peripheral surface of the stator from the region facing the exhaust port to a tip of the stator.

The tapered structure is formed throughout an entire area of the outer peripheral surface of the stator.

The outer peripheral surface of the stator includes a large-diameter section formed on one end on the suction port side and a small-diameter section formed on the other end on the tip side, and the small-diameter section faces the exhaust port.

The conductance increasing function section is formed on the inner peripheral surface of the base, and a groove recessed on the inner peripheral surface of the base is formed in a predetermined angle range in a circumferential direction including a region where the exhaust port is open.

An annular groove is formed on a bottom surface of the base, the bottom surface facing the exhaust path.

The entire exhaust port faces the outer peripheral surface of the stator.

According to the present invention, even in the vacuum pump in which the exhaust port and the stator face each other, the conductance increasing function section is formed at least one of the stator and the inner peripheral surface of the base, thereby making it possible to improve the conductance of the exhaust path. Therefore, for example, even when a reduction of the height of the pump is required, it is possible to prevent deterioration of the exhaust performance of the vacuum pump.

DETAILED DESCRIPTION OF PREFERRED EMBODIMENTS

Vacuum pumps desirably have high exhaust performance. On the other hand, the height of the vacuum pumps is restricted by various factors. That is, downsizing and high exhaust performance are required at the same time in vacuum pumps. The present invention relates to a vacuum pump that is downsized, particularly, reduced in height without causing deterioration of the exhaust performance thereof.

In order to describe the vacuum pump of the present invention, a turbo-molecular pump which includes, as a vacuum exhaust section, a turbo pump section and a drag pump section will be described as an example. Further, the present invention can also be applied to vacuum pumps such as a molecular drag pump which includes no turbo pump section, but only a drag pump section as a vacuum exhaust section.

First Embodiment

Figure 1:
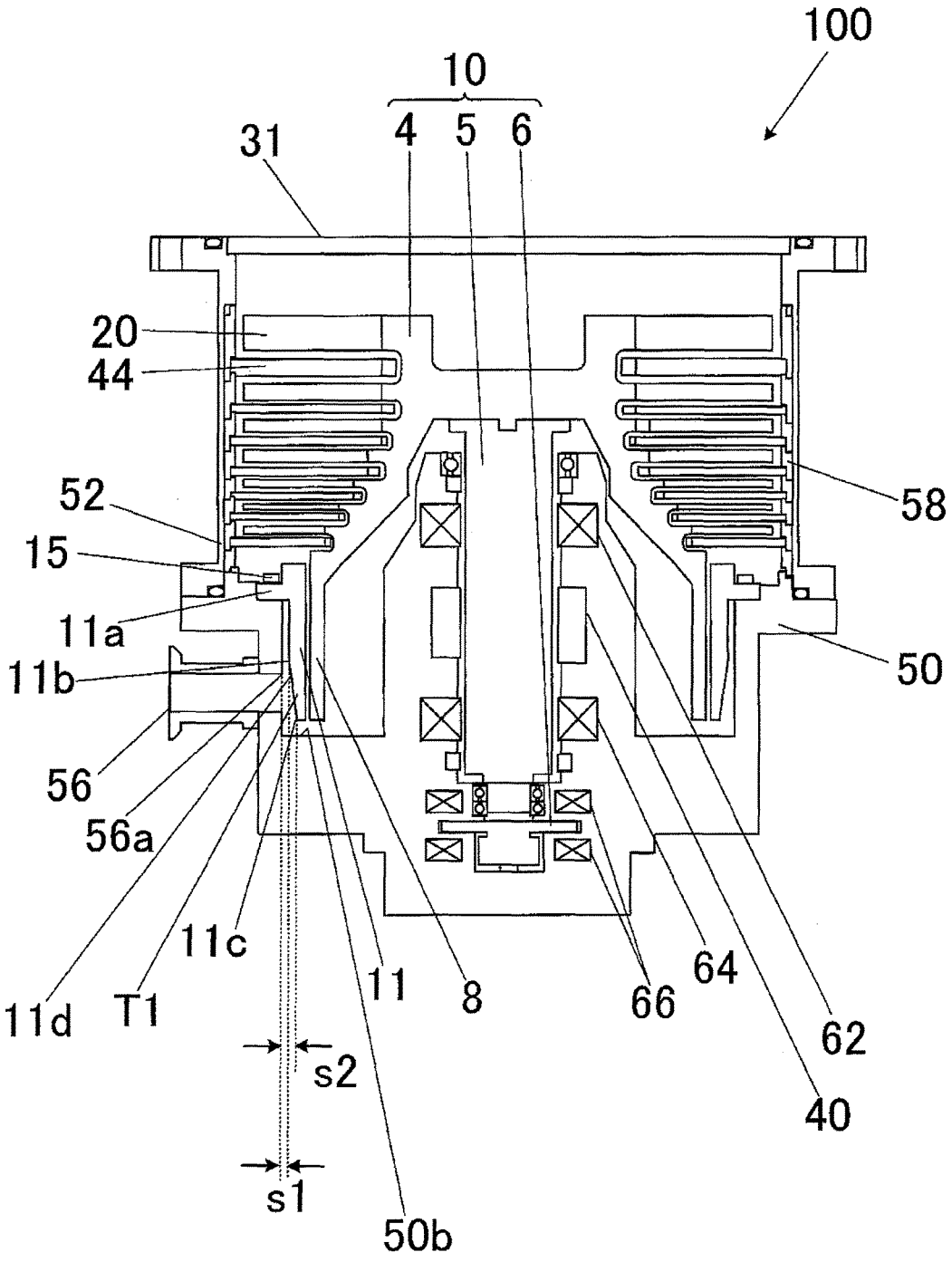
FIG. 1 is a diagram showing a turbo-molecular pump of a first embodiment.

FIG. 1 is a cross-sectional view showing a schematic configuration of a turbo-molecular pump 100. The turbo-molecular pump 100 includes, as a vacuum exhaust section, a turbo pump section and a drag pump section. A rotor assembly is rotatably disposed inside a casing 52 of the turbo-molecular pump 100. The rotor assembly 10 includes a rotor 4, a shaft 5, and a rotor disk 6. The turbo-molecular pump 100 is a magnetic bearing pump. The rotor assembly 10 is supported in a contactless manner by an upper radial electromagnet 62, a lower radial electromagnet 64, and a thrust electromagnet 66.

The rotor 4 is provided with a plurality of stages of rotor blades 20 and a rotor cylindrical section 8. A plurality of stator blades 44 are arranged between the respective stages of the rotor blades 20. The rotor blades 20 and the stator blades 44 constitute the turbo pump section. A screw stator (stator cylindrical section) 11 is disposed on the outer peripheral side of the rotor cylindrical section 8. The screw stator 11 and the rotor cylindrical section 8 constitute the drag pump section. The screw stator 11 is formed of, for example, an aluminum alloy. The screw stator 11 is fixed to a base 50 with bolts 15 through a flange section 11*a*. Instead of forming a screw groove on the stator cylindrical section 11, a screw groove may be formed on the rotor cylindrical section 8.

Each of the stator blades 44 is disposed on the base 50 with each spacer 58 interposed therebetween. When the casing 52 is fixed to the base 50, the stacked spacers 58 are put between the base 50 and the casing 52, and the stator blades 44 are positioned, accordingly.

An exhaust port 56 is disposed on the base 50. A back pump is connected to the exhaust port 56. The rotor assembly 10 is driven by the motor 40 to rotate at high speed while being magnetically levitated by the upper radial electromagnet 62, the lower radial electromagnet 64, and the thrust electromagnet 66. Accordingly, gas that has been sucked through a suction port 31 is discharged through the exhaust port 56 by an exhaust operation performed by cooperation between the rotor blades 20 and the stator blades 44 as the turbo pump section or cooperation between the rotor cylindrical section 8 and the screw stator 11 as the drag pump section. In the present embodiment, the entire exhaust port 56 is arranged to face the outer peripheral surface of the screw stator 11.

Gas that has been discharged by the cooperation between the screw stator 11 and the rotor cylindrical section 8 passes through a space surrounded by the outer peripheral surface of the screw stator 11, the inner peripheral surface of the base 50, and a bottom surface 50*b* of the base 50 as a main exhaust path, and is discharged through the exhaust port 56. In the present embodiment, the entire exhaust port 56 faces the screw stator 11. A tapered structure T1 is formed at least on a part of the outer peripheral surface of the screw stator 11, the part being located from a region facing the exhaust port 56 to the tip of the screw stator 11. In other words, the screw stator 11 has the tapered structure T1 which is formed on the whole circumference of apart of the outer peripheral surface thereof from the region facing the exhaust port 56 to a tip 11*c* of the screw stator 11.

Detailed description will be made as follows. The tapered structure T1 is formed at least on the whole circumference of a region from a position 11*d* which faces an end 56*a* of the exhaust port 56, the end 56*a* on the suction port 31 side (hereinbelow, referred to as "suction port side end 56*a*"), to the tip 11*c* of the screw stator 11. The tip 11*c* indicates the tip of the screw stator 11 in a rotation axis direction of the turbo-molecular pump 100, that is, in a rotation axis direction of the rotor assembly 10, which will be the same hereinafter. The tapered structure T1 has a shape whose diameter continuously decreases toward the downstream side (that is, the distance between the outer periphery of the screw stator 11 and the inner periphery of the base 50 continuously increases). The tapered structure T1 is not limited to a linear tapered structure as shown in FIG. 1, and may be a curved (parabola, exponential function) tapered structure.

Due to the existence of the tapered structure T1, a distance s2 between the outer peripheral surface of the tip 11*c* of the screw stator 11 and the inner peripheral surface of the base 50 near the exhaust port 56 is larger than a distance s1 between the outer peripheral surface of the screw stator 11 and the inner peripheral surface of the base 50 near the flange section 11*a* of the screw stator 11.

The tapered structure T1 is formed from the position 11*b* on the outer peripheral surface of the screw stator 11 to the tip 11*c* of the screw stator 11. The position 11*b* is located between the suction port 31 and the position 11*d* facing the suction port side end 56*a* of the exhaust port 56.

Figures 7A, 7B, 7C, 7D, 7E, 7F, 7G, 7H, 7I, 7J:
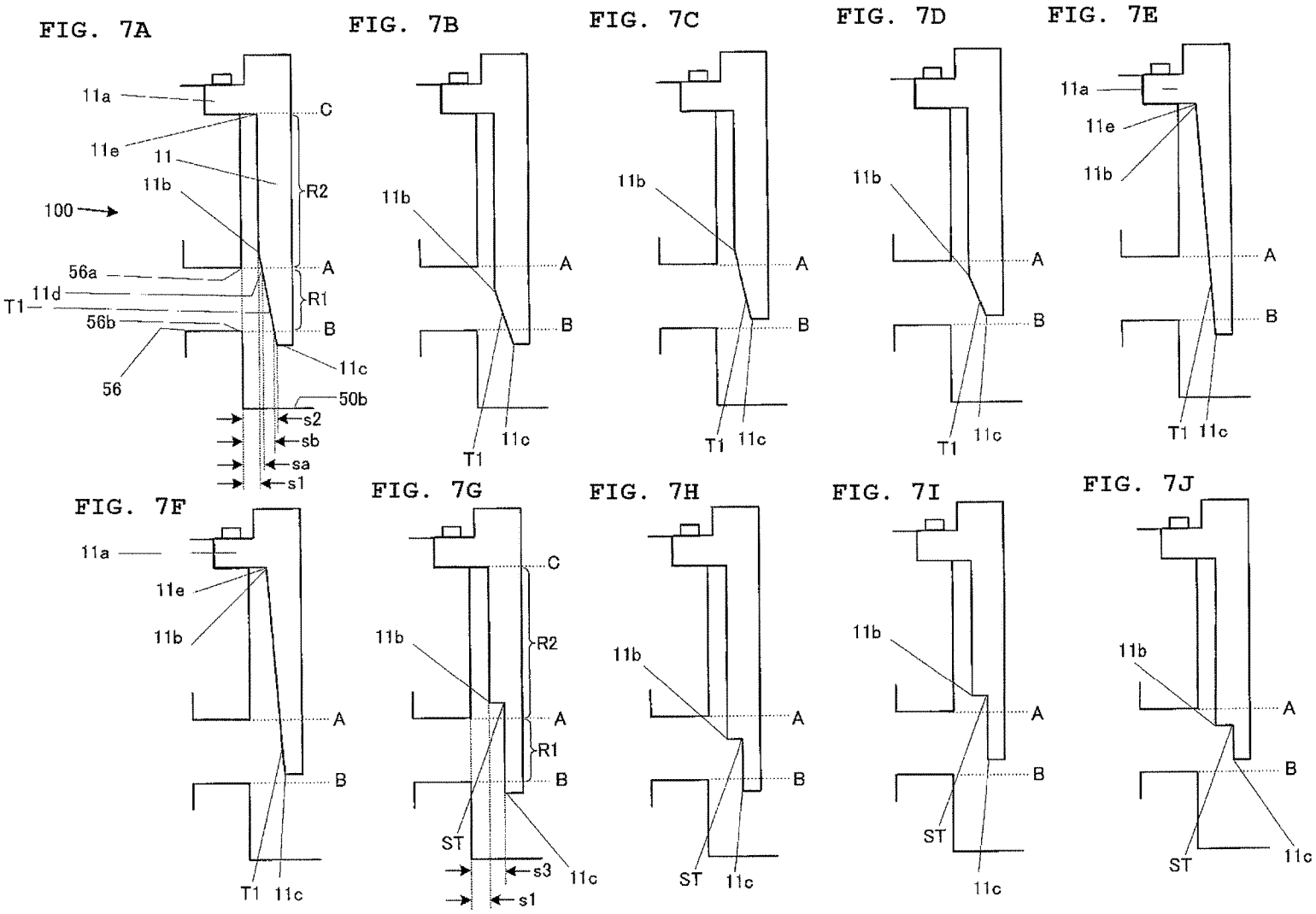
FIGS. 7A to 7J are diagrams each showing the positional relationship between a region of a screw stator and an exhaust port in the present invention.

More detailed description will be made with reference to FIG. 7A. In FIG. 7A, reference mark A represents an axial direction position where the suction port side end 56*a* of the exhaust port 56 is projected on the screw stator 11, and reference mark B represents an axial direction position where an end 56*b* of the exhaust port 56, the end 56*b* on the bottom surface 50*b* side of the base 50, is projected on the screw stator 11. Further, reference mark C represents an axial direction position of a surface of the base 50 to which the screw stator 11 is attached.

A region R1 on the outer peripheral surface of the screw stator 11, the region R1 facing the exhaust port 56, is interposed between the axial direction positions A and B. A region R2 on the outer peripheral surface of the screw stator 11, the region R2 being located between the region R1 and the suction port, is interposed between the axial direction positions A and C of FIG. 7A. A distance sa between the screw stator 11 and the base 50 at the axial direction position A has a minimum value of the distance between the outer peripheral surface of the screw stator 11 in the region R1 and the inner peripheral surface of the base 50. The distance sa is larger than the distance s1 between the outer peripheral surface of the screw stator 11 in the region R2 and the inner peripheral surface of the base 50.

In the turbo-molecular pump 100 of the first embodiment, a distance sb between the screw stator 11 and the base 50 at the axial direction position B is larger than the distance sa between the screw stator 11 and the base 50 at the axial direction position A. The distance s2 between the outer peripheral surface of the tip of the screw stator 11 and the inner peripheral surface of the base has the following magnitude relationship.

s2>sb>sa>s1

The tapered structure T1 having the above configuration improves the conductance of gas in the exhaust path for gas discharged by the screw stator 11 and the rotor cylindrical section 8 leading to the exhaust port 56. Thus, even when the exhaust port 56 and the screw stator 11 are arranged to face each other to thereby reduce the height of the pump, the exhaust performance of the turbo-molecular pump 100 is not deteriorated.

The first embodiment having the above configuration achieves the following effects.

(1) The turbo-molecular pump 100 of the first embodiment is a vacuum pump which discharges gas that has been sucked through the suction port 31 of the casing 52, through the exhaust port 56 disposed on the base 50 by the vacuum exhaust section. The vacuum exhaust section of the turbo-molecular pump 100 of the first embodiment includes the turbo pump section, that is, a turbine exhaust section, and the drag pump section, that is, the screw exhaust section. Gas that has been sucked through the suction port 31 is evacuated by the turbo pump section. Then, the gas is further evacuated by the drag pump section and discharged. The gas discharged from the drag pump section passes through the exhaust path between the outer peripheral surface of the screw stator 11 and the inner peripheral surface of the base 50, and is then discharged to the outside through the exhaust port 56. The drag pump section at least includes the screw stator 11 which is fixed to the base 50 and the rotor 4 provided with the rotor cylindrical section 8 which discharges gas in cooperation with the screw stator 11.

Here, a concept of "conductance increasing function section" will be described. In a pump rotation axis direction (up-down direction of FIG. 1), the outer peripheral surface of the screw stator 11 and the inner peripheral surface of the base 50 are both located from a position where the exhaust port 56 and the screw stator 11 face each other through a position where the bottom surface 50*b* of the base 50 faces the exhaust path. The conductance increasing function section for expanding the exhaust path is provided in at least one of the outer peripheral surface of the screw stator 11 and the inner peripheral surface of the base 50. The conductance increasing function section in the first embodiment is the tapered structure T1 formed on the outer peripheral surface of the screw stator 11. Each turbo-molecular pump 100 in the first to fourth embodiments is provided with the conductance increasing function section. Further, as will be described in Modification 3 of the first embodiment, a circular groove may be formed on the bottom surface 50*b* of the base 50 facing the exhaust path to thereby expand the exhaust path.

Figure 2:
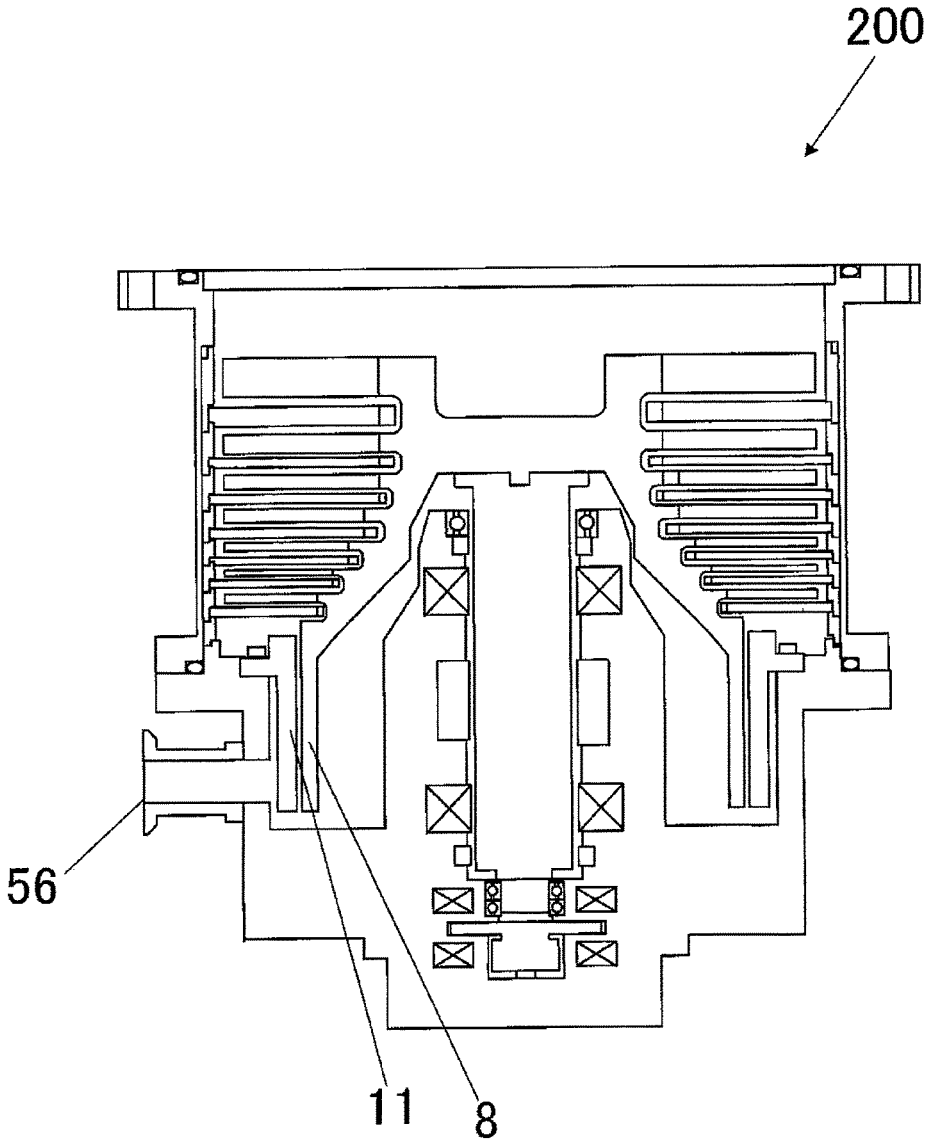
FIG. 2 CONVENTIONAL ART
FIG. 2 is a diagram showing a turbo-molecular pump of a comparative example.

FIG. 2 is a diagram showing a turbo-molecular pump 200 of a comparative example. A principal difference between the configuration of the turbo-molecular pump 200 (FIG. 2) and the configuration of the turbo-molecular pump 100 of the present embodiment (FIG. 1) is the shape of the outer peripheral surface of the screw stator 11. As shown in FIG. 2, in the turbo-molecular pump 200 of the comparative example, a screw stator 11 and an exhaust port 56 face each other and the outer peripheral surface of the screw stator 11 has a constant diameter (straight cylindrical shape). That is, the distance s1 and the distance s2 shown in FIG. 1 are equal. Unfortunately, such a configuration narrows an exhaust path between the exhaust port 56 and the screw stator 11, reduces the conductance of the exhaust path, and thus deteriorates the vacuum exhaust performance.

On the other hand, the tapered structure T1 is formed on the screw stator 11 in the present embodiment. Thus, as described above, it is possible to improve the conductance of the exhaust path for gas discharged by the screw stator 11 and the rotor cylindrical section 8 leading to the exhaust port 56. As a result, it is possible to improve the exhaust performance of the turbo-molecular pump.

(2) The tapered structure T1 formed on the screw stator 11 enables the volume of the screw stator 11 of the present embodiment to be smaller than the volume of the screw stator 11 of the turbo-molecular pump 200 of the comparative example shown in FIG. 2. Assuming that the screw stator 11 receives a constant amount of heat from the rotor cylindrical section 8, the amount of heat received from the rotor cylindrical section 8 per unit volume of the screw stator 11 increases by the tapered structure T1 of the screw stator 11. Thus, the temperature of the screw stator 11 increases.

In a vacuum chamber to which the turbo-molecular pump 100 is attached, various substances that have been generated by various kinds of processing and have entered the pump adhere to the surface of the screw stator 11. The screw stator 11 of the turbo-molecular pump 100 of the first embodiment becomes a higher temperate state than that of the turbo-molecular pump 200 of the comparative example, that is, the screw stator 11 is preferably heated up to a temperature that is higher than or close to the sublimation temperatures of the various substances. This prevents the substances that have been generated, for example, in the vacuum chamber from adhering to the surface of the screw stator 11.

(3) The tapered structure T1 formed on the screw stator 11 enables the volume of the screw stator 11 of the present embodiment to be smaller than that of the screw stator 11 of the turbo-molecular pump 200 of the comparative example shown in FIG. 2. Thus, it is possible to reduce the cost of materials.

As described in the present embodiment, the tapered structure T1 is preferably formed at least in the region from the position 11*d* which faces the suction port side end 56*a* of the exhaust port 56 through the tip 11*c*, that is, the region R1 shown in FIG. 7A. However, as shown in FIG. 7B and FIG. 7D, for example, a screw stator 11 that has a tapered structure T1 formed only on the whole circumference of a part of the region R1 also has a higher exhaust performance than a screw stator 11 having no tapered structure like the screw stator 11 of the turbo-molecular pump 200 shown in FIG. 2. Further, it is possible to prevent substances from adhering to the surface of the screw stator 11, and also to reduce the cost of materials.

Modification 1 of First Embodiment

The casing 52 may have a constriction which connects a flange of the suction port and a straight cylindrical section of the casing 52. The constriction is formed when the diameter of the exhaust port of the vacuum chamber is smaller than the diameter of the straight cylindrical section of the casing 52 of the turbo-molecular pump 100 and the diameter of the suction port 31 of the turbo-molecular pump 100 is thus required to conform to the diameter of the exhaust port of the vacuum chamber. Typically, no exhaust mechanism is provided inside the constriction. Forming the constriction while maintaining the exhaust performance further restricts the height of the entire turbo-molecular pump 100. The present invention is also effective for the turbo-molecular pump 100 that has such a constriction.

Modification 2 of First Embodiment

In recent years, there has also been put to practical use an integrated turbo-molecular pump 100 that includes a power supply device disposed right under a pump main body. Placing the integrated turbo-molecular pump 100 further restricts the height of the pump main body. The present invention is also effective for such a power-supply integrated turbo-molecular pump 100.

Modification 3 of First Embodiment

Figure 3:
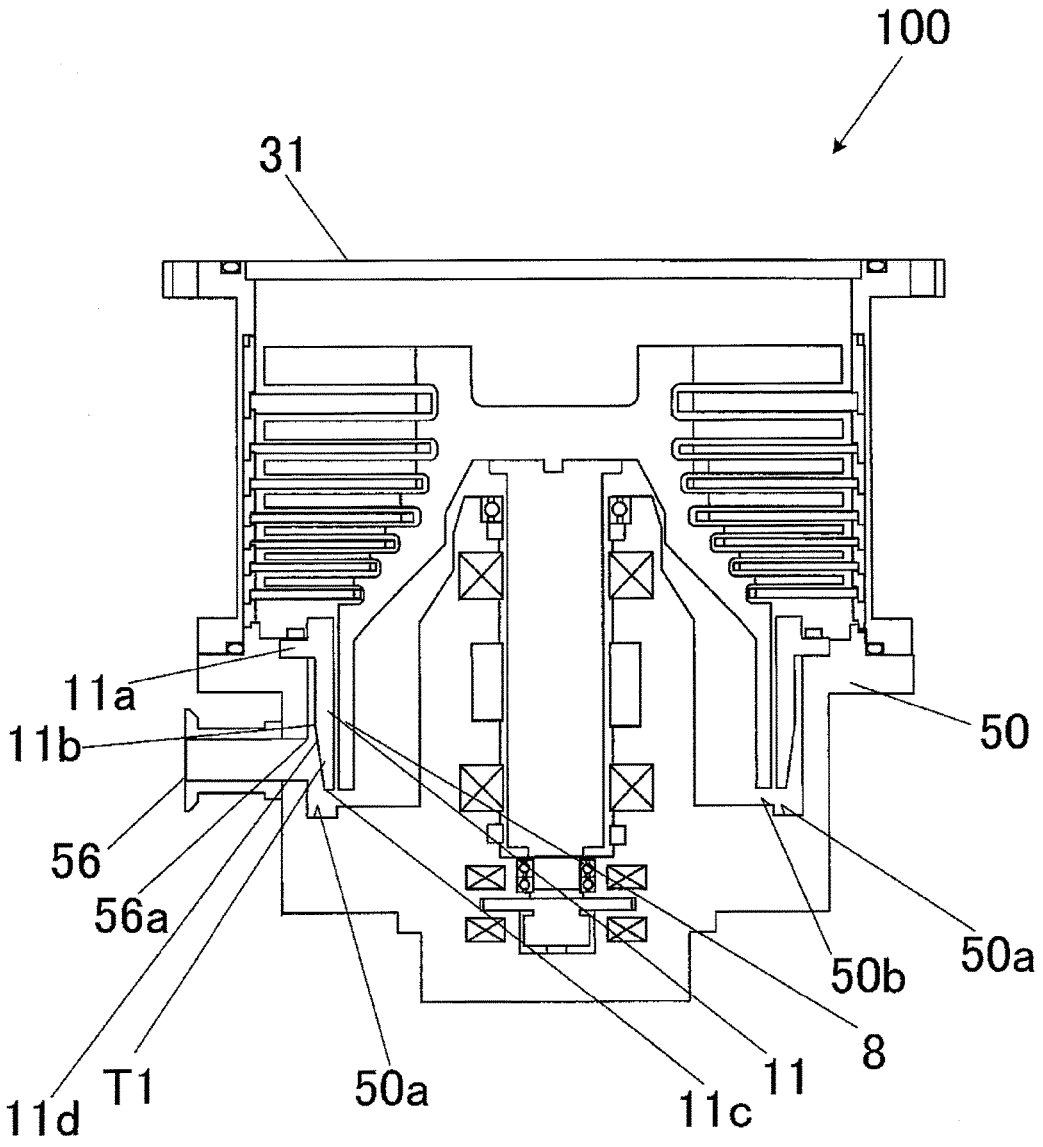
FIG. 3 is a diagram showing a turbo-molecular pump of a modification of the first embodiment.

FIG. 3 is a diagram showing a turbo-molecular pump 100 in Modification 3 of the first embodiment. Description for the same configuration as that of the first embodiment will be omitted.

As shown in FIG. 3, a principal difference from the turbo-molecular pump 100 of the first embodiment shown in FIG. 1 is an annular groove 50*a* which is formed on the whole circumference of the bottom surface 50*b* of the base 50, the bottom surface facing an exhaust path.

The exhaust path for gas discharged by the screw stator 11 and the rotor cylindrical section 8 leading to the exhaust port 56 is a space surrounded by the outer peripheral surface of the screw stator 11, the inner peripheral surface of the base 50, and the bottom surface 50*b* of the base 50. The annular groove 50*a* is formed on the whole circumference of the bottom surface 50*b* of the base 50, the bottom surface 50*b* facing the tip 11*c* of the screw stator 11. The annular groove 50*a* expands the exhaust path, thereby making it possible to improve the conductance of gas. Accordingly, it is possible to further improve the exhaust performance of the turbo-molecular pump 100 in addition to achieve the same effect as in the first embodiment.

The annular groove 50*a* is formed at least in a region that faces the tip 11*c* of the screw stator 11.

Modification 4 of First Embodiment

Figure 8A:
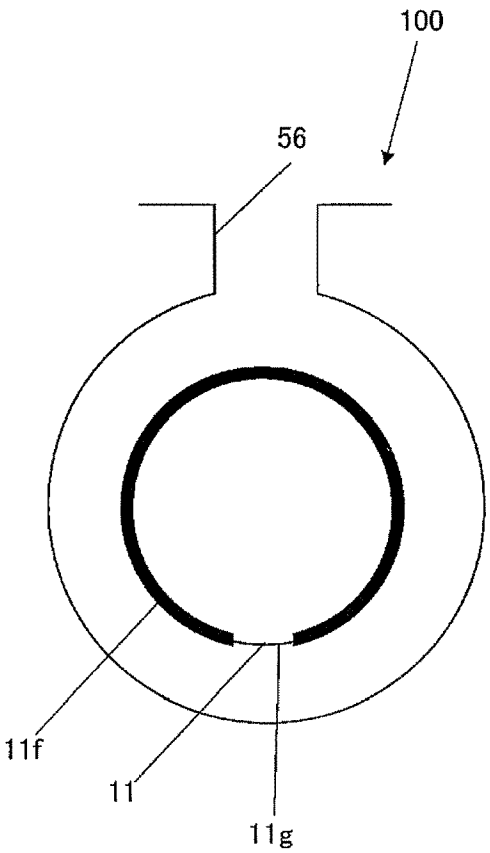
FIGS. 8A to 8C are diagrams each showing a tapered structure of the screw stator, a step of the screw stator, a groove on the inner peripheral surface of a base, and a range of forming a groove on the bottom surface of the base.

In the first embodiment, the tapered structure T1 is formed on the whole circumference of the outer peripheral surface of the screw stator 11. However, the tapered structure T1 may be formed not on the whole circumference, but at least around the exhaust port 56. FIG. 8A is diagram which is viewed from the suction port 31 and illustrates a turbo-molecular pump 100 in which the tapered structure T1 is not formed in a part 11*g* of the outer peripheral surface of the screw stator 11, but formed in the remaining part 11*f* (indicated by a thick line). The turbo-molecular pump 100 having such a configuration is also capable of preventing deterioration of the exhaust performance to some extent.

Modification 5 of First Embodiment

Figure 8B:
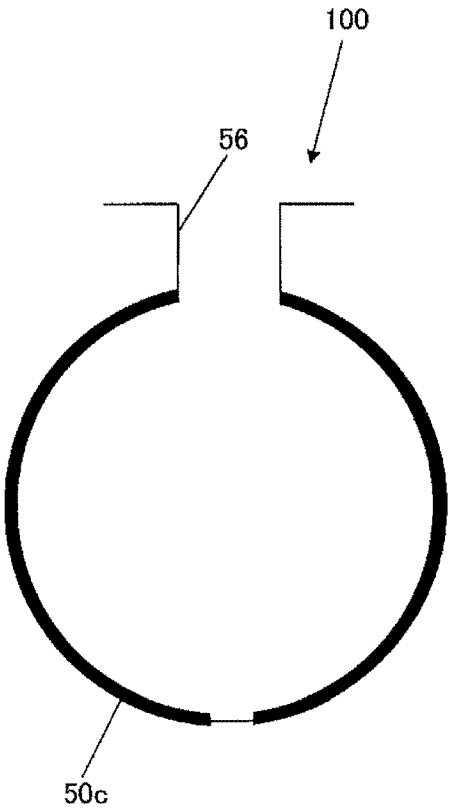
Figure 8C:
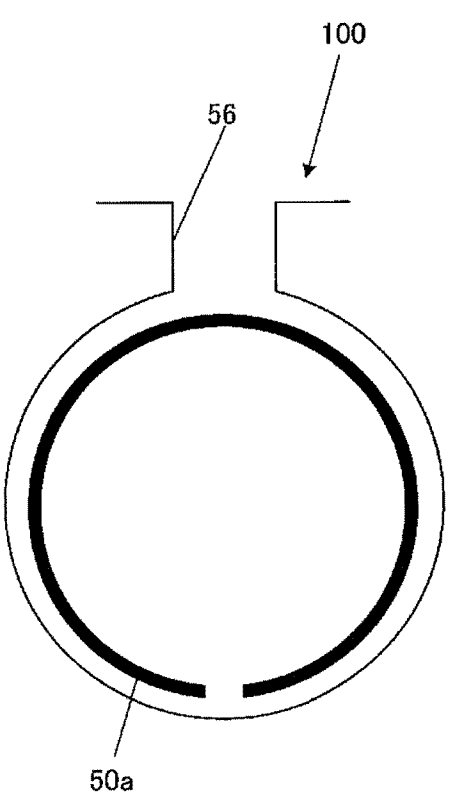

In Modification 3 of the first embodiment, the annular groove 50*a* is formed on the whole circumference of the bottom surface 50*b* of the base 50. However, the annular groove 50*a* may be formed not on the whole circumference of the bottom surface 50*b* of the base 50, but at least around the exhaust port 56. FIG. 8C is a diagram of an annular groove 50*a* on the bottom surface 50*b* of the base 50 viewed from the suction port 31. The annular groove 50*a* is formed not on the whole circumference of the bottom surface 50*b* of the base 50, but only in a predetermined angle range as indicated by a thick line. The turbo-molecular pump 100 having such a configuration is also capable of preventing deterioration of the exhaust performance to some extent.

Second Embodiment

Figure 4:
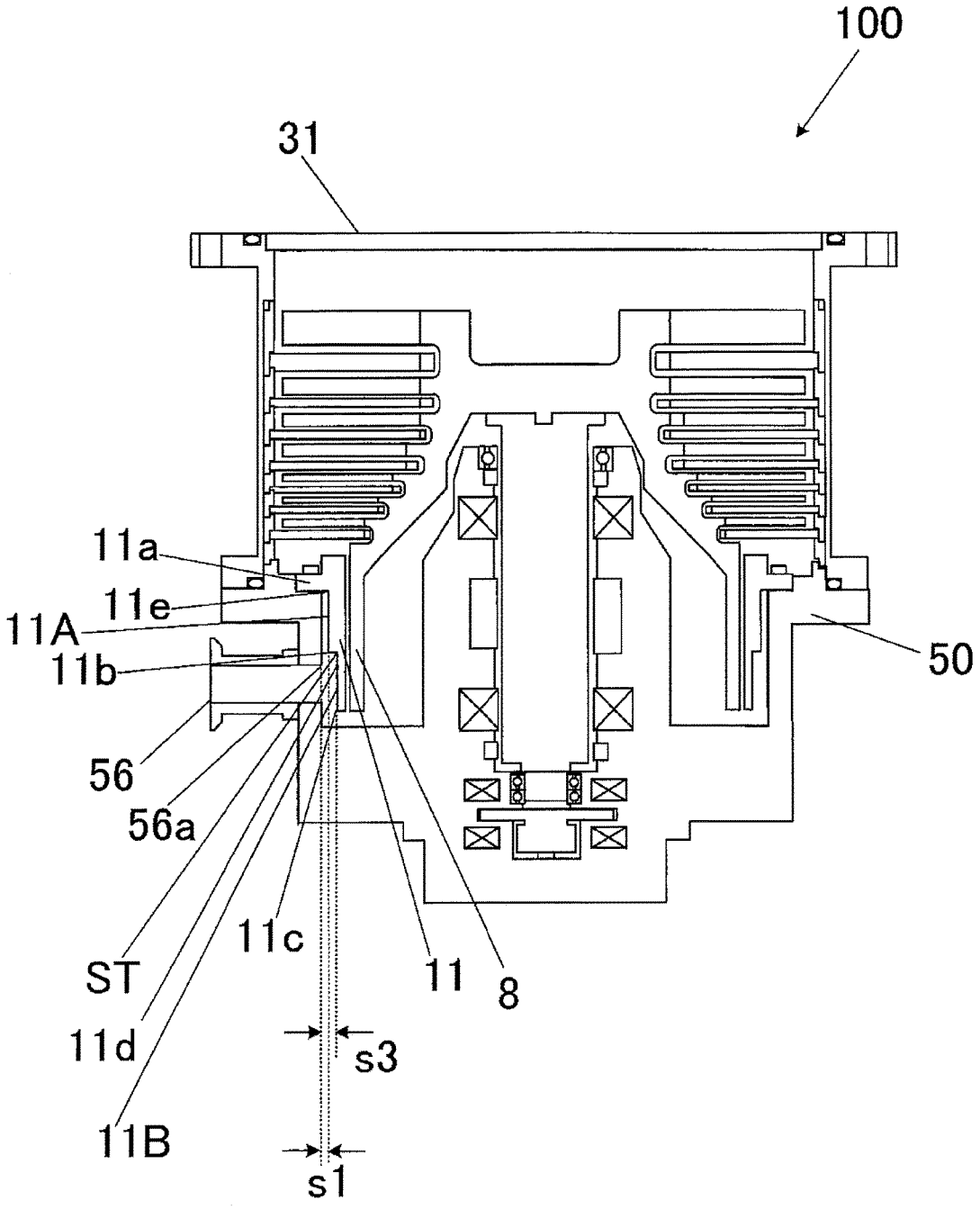
FIG. 4 is a diagram showing a turbo-molecular pump of a second embodiment.

FIG. 4 is a diagram showing a turbo-molecular pump 100 in a second embodiment. Description for the same configuration as that of the first embodiment will be omitted. A conductance increasing function section of the second embodiment is composed of a large-diameter section and a small-diameter section of the outer peripheral surface of a screw stator 11.

The outer peripheral surface of the screw stator 11 of the turbo-molecular pump 100 in the second embodiment has, as the conductance increasing function section, a large-diameter section 11A which is formed on one end on a suction port 31 side and a small-diameter section 11B which is formed on the other end on a tip 11*c* side. The screw stator 11 has a step ST as the boundary between the large-diameter section 11A and the small-diameter section 11B. An exhaust port 56 faces the outer peripheral surface of the screw stator 11, specifically, the peripheral surface of the small-diameter section 11B.

Detailed description will be made as follows. On the outer peripheral surface of the screw stator 11, the small-diameter section 11B is formed at least from a position 11*d* which faces an end 56*a* of the exhaust port 56, the end 56*a* on the suction port 31 side, to the tip 11*c* of the screw stator 11. On the outer peripheral surface of the screw stator 11, the large-diameter section 11A is formed adjacent to the small-diameter section 11B on the suction port 31 side. The diameter of the large-diameter section 11A is larger than the small-diameter section 11B. A distance s3 between the peripheral surface of the small-diameter section 11B of the screw stator 11 and the inner peripheral surface of the base 50 near the exhaust port 56 is larger than a distance s1 between the peripheral surface of the large-diameter section 11A of the screw stator 11 and the inner peripheral surface of the base 50.

In other words, the step ST is formed on the outer peripheral surface of the screw stator 11 on which the large-diameter section 11A and the small-diameter section 11B are formed and improves the conductance of an exhaust path.

More detailed description will be made with reference to FIG. 7G. A region R1 on the outer peripheral surface of the screw stator 11, the region R1 facing the exhaust port 56, is interposed between the axial direction positions A and B. On the outer peripheral surface of the screw stator 11, a region R2 which is interposed between the axial direction positions A and C is formed adjacent to the region R1 on the suction port side. A distance s3 between the outer peripheral surface of the screw stator 11 in the region R1 and the inner peripheral surface of the base 50 is larger than the distance s1 between the outer peripheral surface in the region R2 and the inner peripheral surface of the base 50.

Accordingly, it is possible to improve the conductance of the exhaust path for gas discharged by the screw stator 11 and a rotor cylindrical section 8 leading to the exhaust port 56. Thus, even when the exhaust port 56 and the screw stator 11 are arranged to face each other to thereby reduce the height of the pump, the exhaust performance of the turbo-molecular pump 100 is not deteriorated.

The second embodiment having the above configuration is capable of achieving the same effect as in the first embodiment.

As described in the present embodiment (FIGS. 4 and 7G), the small-diameter section 11B is preferably formed on a part of the outer peripheral surface of the screw stator 11, the part being located from the region R1 through the tip 11*c*. However, as shown in FIGS. 7H and 7J, the small-diameter section 11B may be formed on the whole circumference of a part of the region R1 of the screw stator 11. Also in this case, the exhaust performance is improved compared to the screw stator 11 having no large-diameter section and no small-diameter section like the screw stator 11 of the turbo-molecular pump 200 shown in FIG. 2. Further, it is possible to prevent substances from adhering to the surface of the screw stator 11 and further reduce the cost of materials.

Modification 1 of Second Embodiment

In the second embodiment, the small-diameter section 11B is formed on the whole circumference of the screw stator 11. However, the small-diameter section 11B may be formed not on the whole circumference, but at least around the exhaust port 56. FIG. 8A is diagram which is viewed from the suction port 31 and illustrates a turbo-molecular pump 100 in which the step ST is not formed in a part 11*g* of the outer peripheral surface of the screw stator 11, but formed in the remaining part 11*f* (indicated by a thick line). The turbo-molecular pump 100 having such a configuration is also capable of preventing deterioration of the exhaust performance to some extent.

Modification 2 of Second Embodiment

The annular groove 50*a* described in Modification 3 of the first embodiment may be formed on the bottom surface of the base 50 of the second embodiment.

Modification 3 of Second Embodiment

In Modification 2 of the second embodiment, the annular groove 50*a* is formed on the whole circumference of the bottom surface 50*b* of the base 50. However, the annular groove 50*a* may be formed not on the whole circumference of the bottom surface 50*b* of the base 50, but at least around the exhaust port 56. FIG. 8C is a diagram of an annular groove 50*a* on the bottom surface 50*b* of the base 50 viewed from the suction port 31. The annular groove 50*a* is formed not on the whole circumference of the bottom surface 50*b* of the base 50, but only in a predetermined angle range as indicated by a thick line. The turbo-molecular pump 100 having such a configuration is also capable of preventing deterioration of the exhaust performance to some extent.

Third Embodiment

Figure 5:
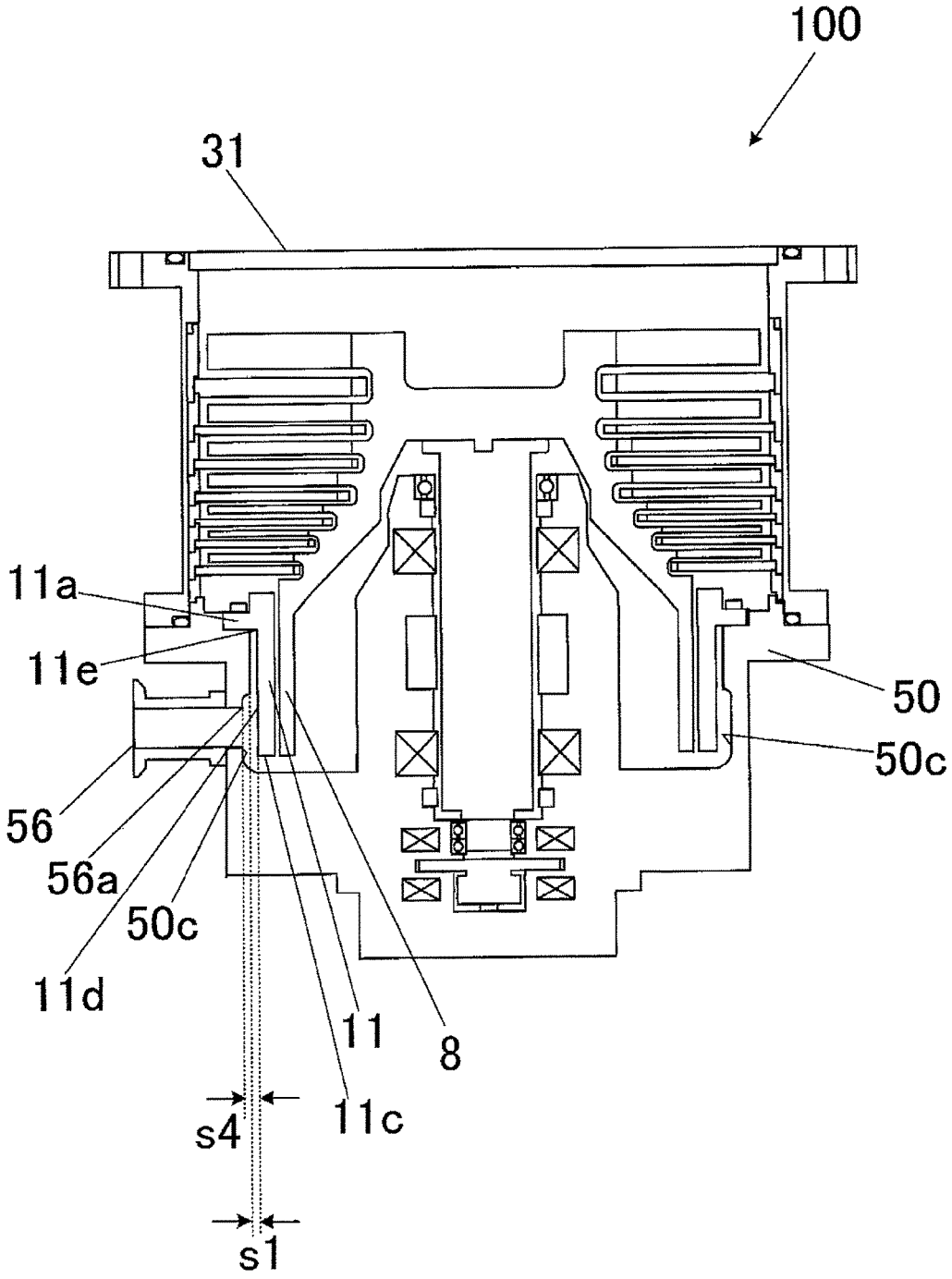
FIG. 5 is a diagram showing a turbo-molecular pump of a third embodiment.

FIG. 5 is a diagram showing a turbo-molecular pump 100 of a third embodiment. A screw stator 11 has the same configuration as the screw stator 11 of the turbo-molecular pump 200 shown in FIG. 2. The third embodiment is the same as the first embodiment except for the screw stator 11 and points described below. Thus, description for the same configuration as that of the first embodiment will be omitted. A conductance increasing function section of the third embodiment is a groove formed on the inner peripheral surface of a base 50.

In the present embodiment, an annular groove 50*c* is formed on the whole circumference of the inner peripheral surface of the base 50, and an exhaust port 56 is open to face the annular groove 50*c*. That is, the annular groove 50*c* which is recessed on the inner peripheral surface of the base 50 is formed in a predetermined angle range in the circumferential direction including a region where the exhaust port 56 is open, specifically, a 360° range in the third embodiment. In the present embodiment, the annular groove 50*c* serves as the conductance increasing function section.

The width of the annular groove 50*c* in the rotation axis direction of the turbo-molecular pump 100 is larger than the diameter of the exhaust port 56. Due to the existence of the annular groove 50*c*, a distance s4 between the outer peripheral surface of the screw stator 11 and the inner peripheral surface of the base 50 near the exhaust port 56 is larger than a distance s1 between the outer peripheral surface of the screw stator 11 and the inner peripheral surface of the base 50 near a flange section 11*a* of the screw stator 11. Accordingly, it is possible to improve the conductance of an exhaust path for gas discharged by the screw stator 11 and the rotor cylindrical section 8 leading to the exhaust port 56. As a result, it is possible to improve the exhaust performance of the turbo-molecular pump 100.

Modification of Third Embodiment

In the third embodiment, the annular groove 50*c* is formed on the whole circumference of the inner peripheral surface of the base 50. However, the annular groove 50*c* may not be formed on the whole circumference of the inner peripheral surface of the base 50. The annular groove 50*c* may be formed only around the exhaust port 56, that is, in a predetermined angle range in the circumferential direction including a region where the exhaust port 56 is open. FIG. 8B is a diagram viewed from the suction port 31. An annular groove 50*c* indicated by a thick line is formed not on the whole circumference of the inner peripheral surface of the base 50, but only in a predetermined angle range. The turbo-molecular pump 100 having such a configuration is also capable of preventing deterioration of the exhaust performance to some extent.

Fourth Embodiment

Figure 6:
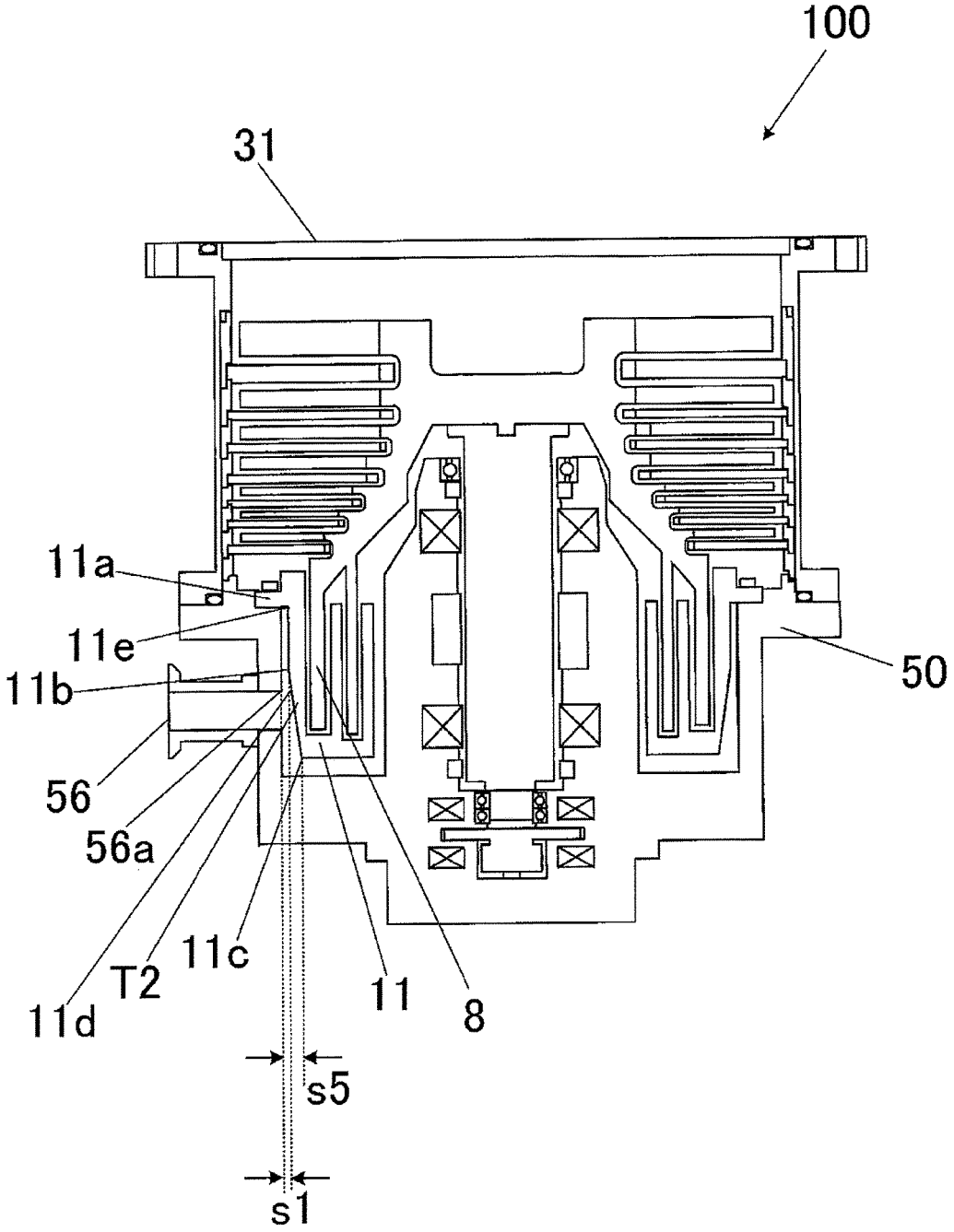
FIG. 6 is a diagram showing a turbo-molecular pump of a fourth embodiment.

FIG. 6 is a diagram showing a turbo-molecular pump 100 in a fourth embodiment. Description for the same configuration as that of the first embodiment will be omitted.

As shown in FIG. 6, a screw stator 11 and a rotor cylindrical section 8 in the fourth embodiment have a multiple structure. The multiple structure means that a plurality of rotor cylindrical sections 8 or a plurality of cylindrical sections of the screw stator 11 are provided in the radial direction of the turbo-molecular pump 100, that is, the right-left direction in the drawing. In the present embodiment, in opposed surfaces of the screw stator 11 and the rotor cylindrical section 8, a screw groove is formed on the surface of the screw stator 11. The multiple structure makes it possible to further compress gas, and thereby achieve a higher vacuum state.

In the fourth embodiment, a tapered structure T2 is formed, as a conductance increasing function section, in a predetermined range of the outermost peripheral surface of the screw stator 11. A distance s5 between the outermost peripheral surface of the screw stator 11 in a region where the tapered structure T2 is formed and the inner peripheral surface of the base 50 is larger than a distance s1 between the outermost peripheral surface of the screw stator 11 in a region where the tapered structure T2 is not formed and the inner peripheral surface of the base 50. In FIG. 6, the distance between the outermost peripheral surface of the screw stator 11 at a tip 11*c* and the inner peripheral surface of the base 50 is illustrated as an example of the distance s5.

Forming the tapered structure T2 makes the distance s5 larger than the distance s1, thereby making it possible to improve the conductance of an exhaust path for gas discharged by the screw stator 11 and the rotor cylindrical section 8 leading to the exhaust port 56. As a result, it is possible to improve the exhaust performance of the turbo-molecular pump 100.

In the present embodiment, in the opposed surfaces of the screw stator 11 and the rotor cylindrical section 8, the screw groove is formed on the opposed surface of the screw stator 11. However, the screw groove may be formed on at least either one of the opposed surfaces of the screw stator 11 and the rotor cylindrical section 8.

Modification 1 of Fourth Embodiment

In the fourth embodiment, the tapered structure T2 is formed on the whole circumference of the screw stator 11. However, the tapered structure T2 may be formed not on the whole circumference, but at least around the exhaust port 56. FIG. 8A is diagram which is viewed from the suction port 31 and illustrates a turbo-molecular pump 100 in which the tapered structure T2 is not formed in apart 11*g* of the outer peripheral surface of the screw stator 11, but formed in the remaining part 11*f* (indicated by a thick line). The turbo-molecular pump 100 having such a configuration is also capable of preventing deterioration of the exhaust performance to some extent.

The annular groove 50*a* described in the modifications of the first embodiment can be formed on the bottom surface of the base 50 of the fourth embodiment.

In the first to fourth embodiments, the entire exhaust port 56 faces the outer peripheral surface of the screw stator 11. The present invention can also be applied also to a turbo-molecular pump 100 in which only a part of the exhaust port 56 faces the outer peripheral surface of the screw stator 11, that is, a turbo-molecular pump 100 in which the tip 11*c* of the screw stator 11 faces the exhaust port 56.

Here, "the entire exhaust port 56 faces the outer peripheral surface of the screw stator 11" means that, when the cross-sectional shape of the exhaust port 56 is projected on the outer peripheral surface of the screw stator 11, the entire projected image is formed on the outer peripheral surface of the screw stator 11. Further, "only a part of the exhaust port 56 faces the outer peripheral surface of the screw stator 11" means that, when the cross-sectional shape of the exhaust port 56 is projected on the outer peripheral surface of the screw stator 11, a part of the projected image is deviated from the outer peripheral surface of the screw stator 11.

FIGS. 7A to 7J show specific positional relationships between the tip 11*c* and the position 11*b* of the screw stator 11 and the exhaust port 56. As described above, FIG. 7A shows the screw stator 11 of the first embodiment and the positional relationship between the screw stator 11 and the exhaust port 56. FIGS. 7B to 7F show modifications of the first embodiment, specifically, the screw stator 11 having the tapered structure T1 on the outer peripheral surface thereof and the positional relationship between the screw stator 11 and the exhaust port 56.

As described above, FIG. 7G shows the screw stator 11 of the second embodiment and the positional relationship between the screw stator 11 and the exhaust port 56. FIGS. 7H to 7J show modifications of the second embodiment, specifically, the screw stator 11 having the step ST on the outer peripheral surface thereof and the positional relationship between the screw stator 11 and the exhaust port 56. The tapered structure T2 described in the fourth embodiment is similar to the tapered structure T1 described in the first embodiment. Thus, FIGS. 7B to 7F show modifications of the tapered structure T1 of the first embodiment as representative examples. The turbo-molecular pumps of all of these embodiments and modifications are capable of achieving the above effects.

FIG. 7A shows the first embodiment which is characterized in that the position 11*b* is located between the position A and the suction port and the tip 11*c* is located between the position B and the bottom surface of the base. When the position 11*b* matches an end 11*e* of the flange section 11*a*, the end 11*e* on the exhaust port 56 side, the tapered structure T1 is formed throughout the entire area of the outer peripheral surface of the screw stator 11 as shown in FIG. 7E.

FIG. 7B shows a configuration characterized in that the position 11*b* is located between the position A and the bottom surface of the base and the tip 11*c* is located between the position B and the bottom surface of the base. FIG. 7C shows a configuration characterized in that the position 11*b* is located between the position A and the suction port and the tip 11*c* is located between the position B and the suction port. FIG. 7D shows a configuration characterized in that the position 11*b* is located between the position A and the bottom surface of the base and the tip 11*c* is located between the position B and the suction port. In FIG. 7C, when the position 11*b* matches the end 11*e* of the flange section 11*a*, the position 11*b* on the exhaust port 56 side, the tapered structure T1 is formed throughout the entire area of the outer peripheral surface of the screw stator 11 as shown in FIG. 7F.

FIG. 7G shows the second embodiment which is characterized in that the position 11*b* is located between the position A and the suction port and the tip 11*c* is located between the position B and the bottom surface of the base.

FIG. 7H shows a configuration characterized in that the position 11*b* is located between the position A and the bottom surface of the base and the tip 11*c* is located between the position B and the bottom surface of the base. FIG. 7I shows a configuration characterized in that the position 11*b* is located between the position A and the suction port and the tip 11*c* is located between the position B and the suction port. FIG. 7J shows a configuration characterized in that the position 11*b* is located between the position A and the bottom surface of the base and the tip 11*c* is located between the position B and the suction port.

All of the turbo-molecular pumps 100 shown in FIGS. 7A to 7I are capable of achieving the effects described in the first embodiment.

The embodiments and modifications described above can be combined without departing from the scope of the invention. For example, the conductance increasing function section may be provided in both the screw stator 11 and the inner peripheral surface of the base 50.

The above description is merely an example. The present invention is not limited at all to the above description. Therefore, the present invention also includes vacuum pumps having various forms each provided with a screw stator which is fixed to a base and a rotor which has a rotor cylindrical section which discharges gas in cooperation with the screw stator, wherein at least a part of an exhaust port faces the outer peripheral surface of the screw stator, gas that has been sucked through a suction port of a casing by a vacuum exhaust section is discharged through the exhaust port disposed on the base, and a conductance increasing function section is formed on at least one of the screw stator and the inner peripheral surface of the base in a region where the exhaust port and the screw stator face each other.

What is claimed is:

1. A vacuum pump comprising:

a vacuum exhaust section, the vacuum exhaust section including a drag pump including a stator and a rotor having a rotor cylindrical section, the rotor cylindrical section discharging gas in cooperation with the stator, a suction port;

a base;

an exhaust port disposed on the base, wherein at least a part of the exhaust port faces an outer peripheral surface of the stator, and gas sucked through the suction port by the vacuum exhaust section is discharged through the exhaust port; wherein a gap is formed between the outer peripheral surface of the stator and an inner peripheral surface of the base from a suction port side end portion of the exhaust port toward the suction port, an outer diameter of the stator is uniform so that a size of the gap measured radially between the outer peripheral surface of the stator and the inner peripheral surface of the base is uniform in a first area of the stator, the first area is from a side towards the suction port to an intermediate position in a rotor axial direction, the vacuum pump further comprises a conductance increasing function section formed on the outer peripheral surface of the stator in a second area of the stator, the second area is from the intermediate position to a side towards the exhaust port, the outer peripheral surface facing an exhaust path for gas discharged by the drag pump leading to the exhaust port, and the conductance increasing function section has a configuration such that the outer diameter of the stator in the second area is smaller than the outer diameter of the stator in the first area.

2. The vacuum pump according to claim 1, wherein a shape of the outer peripheral surface of the stator allows a distance between the outer peripheral surface of the stator in a region facing the exhaust port and the inner peripheral surface of the base to be larger than a distance between the outer peripheral surface of the stator in a region located on the side toward the suction port and not facing the exhaust port and the inner peripheral surface of the base.

3. The vacuum pump according to claim 2, wherein the stator includes a tapered structure formed on the whole circumference of the second area of the stator from the region facing the exhaust port to a tip of the stator.

4. The vacuum pump according to claim 2, wherein the outer peripheral surface of the stator includes a large-diameter section formed in the first area and a small-diameter section formed in the second area, and the small-diameter section faces the exhaust port.

5. The vacuum pump according to claim 1, wherein an additional conductance increasing function section is formed on the inner peripheral surface of the base, and a groove recessed on the inner peripheral surface of the base is formed in a predetermined angle range in a circumferential direction including a region where the exhaust port is open.

6. The vacuum pump according to claim 1, wherein an annular groove is formed on a bottom surface of the base, the bottom surface facing the exhaust path.

7. The vacuum pump according to claim 1, wherein the entire exhaust port faces the outer peripheral surface of the stator.

* * * * *